US006886914B2

(12) United States Patent
Hiramoto et al.

(10) Patent No.: US 6,886,914 B2
(45) Date of Patent: May 3, 2005

(54) LIQUID JETTING APPARATUS

(75) Inventors: Goki Hiramoto, Nagano (JP); Tomoaki Takahashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 17 days.

(21) Appl. No.: 10/264,315

(22) Filed: Oct. 4, 2002

(65) Prior Publication Data

US 2003/0085953 A1 May 8, 2003

(30) Foreign Application Priority Data

Oct. 4, 2001 (JP) ..... P2001-309108

(51) Int. Cl.[7] ..... B41J 2/16; H01B 11/02; H01B 11/06

(52) U.S. Cl. ..... 347/50; 174/34; 174/117 F

(58) Field of Search ..... 347/50, 58; 174/34, 174/117 F, 117 FF

(56) References Cited

U.S. PATENT DOCUMENTS

| | | | | |
|---|---|---|---|---|
| 4,558,332 A | * | 12/1985 | Takahashi | 374/14 |
| 4,698,644 A | * | 10/1987 | Drago et al. | 347/40 |
| 5,003,273 A | * | 3/1991 | Oppenberg | 333/1 |

FOREIGN PATENT DOCUMENTS

| | | |
|---|---|---|
| JP | 9-11581 | 1/1997 |
| JP | 11-042779 | 2/1999 |
| JP | 11-188865 | 7/1999 |
| JP | 2000-190488 | 7/2000 |
| JP | 2000-269612 | 9/2000 |

* cited by examiner

*Primary Examiner*—Michael S. Brooke
(74) *Attorney, Agent, or Firm*—Sughrue Mion, PLLC

(57) ABSTRACT

A flexible flat cable connects a drive circuit and a liquid jetting head to supply a drive signal to pressure generating elements. The flat cable includes a plurality of laminated layers, each provided with a plurality of first conductive patterns each connecting a positive pole of the drive circuit and a positive pole of one of the pressure generating elements, and a plurality of second conductive patterns each connecting a negative pole of the drive circuit and a negative pole of one of the pressure generating elements. Each of at least one of the first conductive patterns provided in one of the laminated layers faces one of the first conductive patterns provided in adjacent one of the laminated layers. Each of at least one of the second conductive patterns provided in one of the laminated layers faces one of the second conductive patterns provided in adjacent one of the laminated layers.

16 Claims, 11 Drawing Sheets

LIQUID JETTING APPARATUS

BACKGROUND OF THE INVENTION

The present invention relates to a liquid jetting apparatus such as a recording head for an ink jet recording apparatus, an electrode member ejection head for an electrode forming apparatus, an organic substance jetting head for a bio-chip manufacturing apparatus, or the like, which records images and characters on a recording sheet by ejecting ink droplets from nozzle orifices.

FIG. 17 shows a related-art ink jet recording apparatus, which is one kind of the liquid jetting apparatus, comprising: a carriage 3, wherein an ink cartridge 1 is mounted on the upper face while a recording head 2 is attached to the lower face, and a cap 4 for covering the recording head 2.

The carriage 3 is connected by a timing belt 5 to a stepping motor 6, and reciprocates along a guide bar 7 in the widthwise direction of a recording sheet 8. A drive circuit 9, which is arranged in a case 10 fixed to a wall frame 11, is provided to control the ejection of ink from the recording head 2. A drive signal output by the drive circuit 9 and various other control signals are transmitted to the recording head 2 by a flexible flat cable 12'.

The recording head 2 is attached to the face of the carriage 3 that is directed to the recording sheet 8 (in this example, the lower face). While the carriage 3 is moving, ink stored in the ink cartridge 1 is supplied to the recording head 2 and is ejected as droplets onto the top face of the recording sheet 8 to print images and characters formed as matrixes of dots.

The cap 4 is arranged in a non-printing region within the range of movement of the carriage 3, and while printing is halted, covers the nozzle face of the recording head 2 to prevent, to the extent possible, ink from drying in the nozzle orifices. Further, the cap 4 is connected to a suction pump 13, and during a cleaning process, a negative pressure is applied to the recording head 2 to draw ink from the nozzle orifices. Furthermore, the cap 4 can also serve as a reservoir for ink droplets that are discharged from the recording head by a flushing operation.

While the carriage 3 is reciprocating and printing is being performed, drive signals transmitted by the drive circuit 9 are carried to the recording head 2 by the flexible flat cable 12', which is repetitively bent. As is shown in FIG. 18, the flexible flat cable 12', which is formed of a flexible and durable synthetic resin 15 that can withstand repeated bending, is shaped like a belt, and within it and constituting multiple conductive lines, conductive patterns 14 are arranged in parallel. In order for the same durability as that exhibited by the synthetic resin 15 to be provided for the conductive patterns 14, they are formed by cutting into narrow strips an extremely thin copper alloy plate.

There are about 30 conductive patterns 14, and in addition, for the several pressure generating elements that depend on a number of different ink types, a ground line, a temperature detection signal line and other power feed lines are provided. Currently, it is necessary for the number of ink types to be increased in order to improve the printing quality, or for the number of signal types transmitted by the drive circuit 9 to the recording head 2 to be increased so as to adapt a recording apparatus to the environmental conditions, such as the temperature and the humidity, in the location whereat it is installed.

As the easiest measure for coping with either of these needs, the width of the flexible flat cable 12' and the number of conductive patterns 14 can be increased. However, when a wider flexible flat cable 12' is continuously bent during printing, it can interfere with associated, peripheral members and prevent the printing operation from being performed smoothly. Otherwise, if the torsional deformation of a wide flexible flat cable 12' occurs, its ends may be stretched too far and torn when it is bent during printing.

In order to resolve these problems, one measure has been proposed whereby, as is shown in FIG. 19, the flexible flat cable 12' is divided into a first flexible flat cable 12'A and a second flexible flat cable 12'B, and these cables 12'A and 12'B are laminated.

FIG. 20A shows the polarities of the conductive patterns 14 of the first and second flexible flat cables 12A and 12B. The hatched conductive patterns 14 represent the positive polarity, and the non-hatched conductive patterns 14 represent the negative polarity.

In such a lamination structure, when the opposite polarities face each other and the two types of conductive patterns 14 are rendered conductive at the same time, the magnetic fields of both conductive patterns 14 are generated in reverse directions, as indicated by the arrows in FIGS. 20A and 20B. In FIG. 20B, only the polarities are depicted for better understanding.

Therefore, the amount of current supplied to the recording head 2 is reduced by a mutual inductance generated between the conductive patterns 14. Accordingly, insufficient drive energy tends to be supplied to the pressure generating elements of the recording head 2, and desired ink ejection can not be performed.

Specifically, an ink ejection shortage will affect only a specific nozzle orifice array of the recording head 2, but due to the pertinent nozzle orifice array, a printing failure will occur that renders all printing results abnormal.

SUMMARY OF THE INVENTION

It is therefore an object of the invention to resolve a problem that arises due to a mutual inductance that is generated between the conductive patterns of the first and second laminated flexible flat cables.

In order to achieve the above object, according to the present invention, there is provided an liquid jetting apparatus, comprising:

a liquid jetting head, provided with nozzle orifices, pressure chambers each commutated with one of the nozzle orifices, and pressure generating elements each associated with one of the pressure chambers to vary pressure of ink contained therein;

a drive circuit, which generates a drive signal for driving at least one of the pressure generating elements; and a flexible flat cable, which connects the drive circuit and the liquid jetting head to supply the drive signal to at least one of the pressure generating elements, the flat cable including a plurality of laminated layers, each provided with a plurality of first conductive patterns each connecting a positive pole of the drive circuit and a positive pole of one of the pressure generating elements, and a plurality of second conductive patterns each connecting a negative pole of the drive circuit and a negative pole of one of the pressure generating elements, wherein:

each of at least one of the first conductive patterns provided in one of the laminated layers faces one of the first conductive patterns provided in adjacent one of the laminated layers; and each of at least one of the second conductive patterns provided in one of the laminated layers faces one of the second conductive patterns provided in adjacent one of the laminated layers.

In this configuration, the polarities of the conductive patterns provided in adjacent laminated layers and faced with each other are made identical. Therefore, when both conductive patterns are conductive, magnetic fields in these conductive patterns are generated in the same direction, and any affect attributable to mutual inductance is reduced. This phenomenon ensures that the strength of the current transmitted to the pressure generating elements does not fluctuate and conforms to that which is anticipated, shortages of ink for ejection are seldom encountered, and normal printing can be performed.

Since the problems associated with the lamination of the flexible flat cables can be resolved, an increase in the signal types transmitted through the flexible flat cable can be handled without the width of the flexible flat cable being increased. Actually, because of the laminated structure, the width of the flexible flat cable can be reduced relative to a related-art cable, and the space occupied by the flexible flat cable during printing can be reduced. This can contribute to a reduction in the size of the recording apparatus.

Preferably, the first conductive patterns facing with each other are associated with pressure generating elements for ejecting different kinds of ink. On the other hand, the second conductive patterns facing with each other are associated with pressure generating elements for ejecting different kinds of ink.

Therefore, the pressure generating elements for a specific ink type and the pressure generating elements for another ink type are driven normally, and even when the conductive patterns for these ink types are opposed, a shortage of ink for ejection seldom occurs, and there is a considerable reduction in the incidence of printing failures.

Preferably, at least one of the first conductive patterns and at least one of second conductive patterns provided in each of the laminated layers are connected to at least one of the pressure generating elements for ejecting one kind of ink.

With this arrangement, the affect attributable to mutual inductance is reduced even when the paired positive conductive and negative conducive patterns face each other in each of the laminated layers. Therefore, the pressure generating elements that cope with the individual ink types can be operated normally, shortages of ink for ejection seldom occur, and there is a considerable reduction in the incidence of printing failures.

Here, is preferable that one of the first conductive patterns and two of the second conductive patterns provided in each of the laminated layers are connected to at least one of the pressure generating elements for ejecting one kind of ink.

With this arrangement, since the current in each negative conductive patterns is reduced by half, the affect attributable to the mutual inductance between the first and second flexible flat cables can be reduced. Thus, the pressure generating elements that cope with the individual ink types can be operated more normally, shortages of ink for ejection seldom occur, and there is a considerable reduction in the incidence of printing failures.

When two of the first conductive patterns and two of the second conductive patterns provided in each of the laminated layers are connected to at least one of the pressure generating elements for ejecting one kind of ink, since the current in each positive conductive pattern and each negative conductive pattern can be reduced, the magnetic effect produced by the conductive patterns can be reduced, and accordingly, the affect attributable to the disturbance relative to the peripheral devices can be lessened.

Preferably, an arrangement order of the first conductive patterns and the second conductive patterns provided in one of the laminated layers is identical with an arrangement order of the first conductive patterns and the second conductive patterns provided in adjacent one of the laminated layers.

In this case, since the positive and negative conductive patterns of the laminated layers need only directly face with each other, the simplest possible method can be used to avoid the affect attributable to mutual inductance.

Here, it is preferable that the first conductive patterns and the second conductive patterns provided in each of the laminated layer are alternately arranged.

Alternatively, an arrangement order of the first conductive patterns and the second conductive patterns provided in one of the laminated layers may be inverse to an arrangement order of the first conductive patterns and the second conductive patterns provided in adjacent one of the laminated layers.

With this arrangement, even when the inverted order arrangement is selected because the polarities of the terminals of the drive circuit and the pressure generating elements, the arrangement in which conductive patterns having the same poles face each other can be implemented.

Here, it is preferable that the first conductive patterns and the second conductive patterns provided in each of the laminated layer are alternately arranged.

Preferably, one of the laminated layers is shifted relative to adjacent one of the laminated layers in an arrangement direction of the first conductive patterns and the second conductive patterns by a distance equivalent to at least one of the first conductive patterns and the second conductive patterns.

With this arrangement, the principle according to which conductive patterns face conductive patterns having the same poles can be established, even when the orders in which the positive conductive patterns and the negative conductive patterns are arranged differ. Therefore, the degree of freedom with which the orders wherein the positive and negative conductive patterns are arranged is enhanced.

Preferably, an auxiliary conductive pattern for supplying a signal other than the drive signal to the liquid jetting head is provided in at least one of the laminated patterns so as to face at least one of the first conductive patterns and the second conductive patterns.

With this arrangement, an extra conductive pattern can be utilized for a ground line, for a temperature detection line or for a power line having another purpose, i.e., the use of an auxiliary conductive pattern that provides no affection for the drive signal can be selected.

Preferably, the flat cable includes a connecting section extending in a longitudinal direction thereof at one widthwise side end so as to integrally connect one of the laminated layers and adjacent one of the laminated layers.

With this arrangement, since a wide flexible flat cable is employed, spatial disadvantages can be avoided by folding the flexible flat cable at the connecting section over onto itself. At the same time, since only a single, wide flexible flat cable is folded, the number of parts is not increased and the manufacturing process is simplified, making this an extremely effective cost reduction arrangement.

Preferably, an adhesive layer is interposed between one of the laminated layers and adjacent one of the laminated layers.

With this arrangement, since the bonding the two flexible flat cables are integrally bonded, the flexible flat cables are not easily peeled apart, even when repetitively bent during operation, and the principle according to which conductive patterns face conductive patterns having like poles can be maintained.

Preferably, the pressure generating elements are one of longitudinal oscillation type piezoelectric vibrators, flexure oscillation type piezoelectric vibrators and heating elements for heating ink in the pressure chambers.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

The preferred embodiments of the present invention will now be described in detail with reference to the accompanying drawings.

Figure 1:
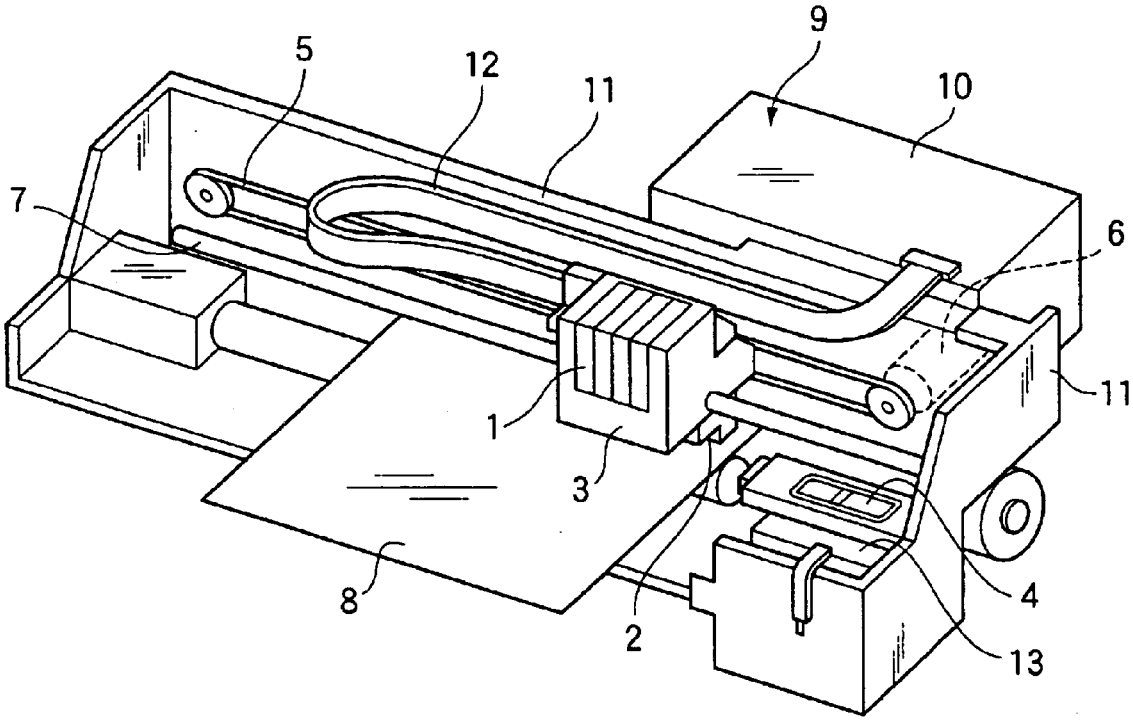
FIG. 1 is a perspective view of an ink jet recording apparatus according to a first embodiment of the present invention.
Figure 17:
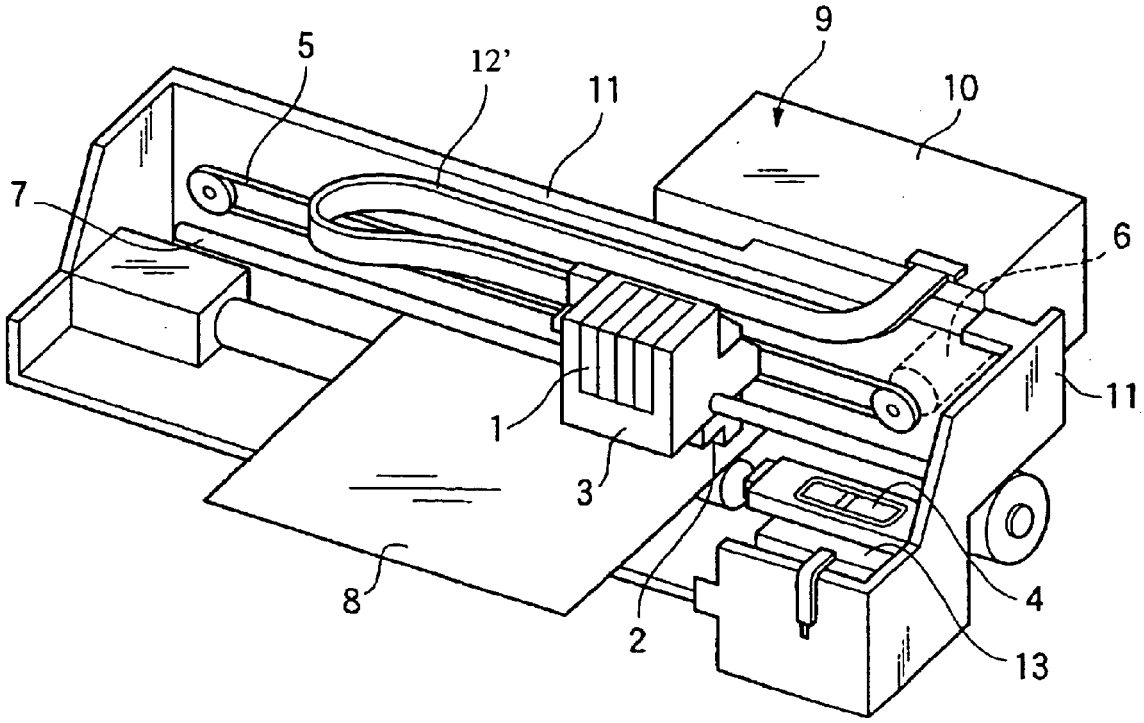
FIG.17 PRIOR ART
FIG. 17 is a perspective view of a related-art ink jet recording apparatus.
Figure 18:
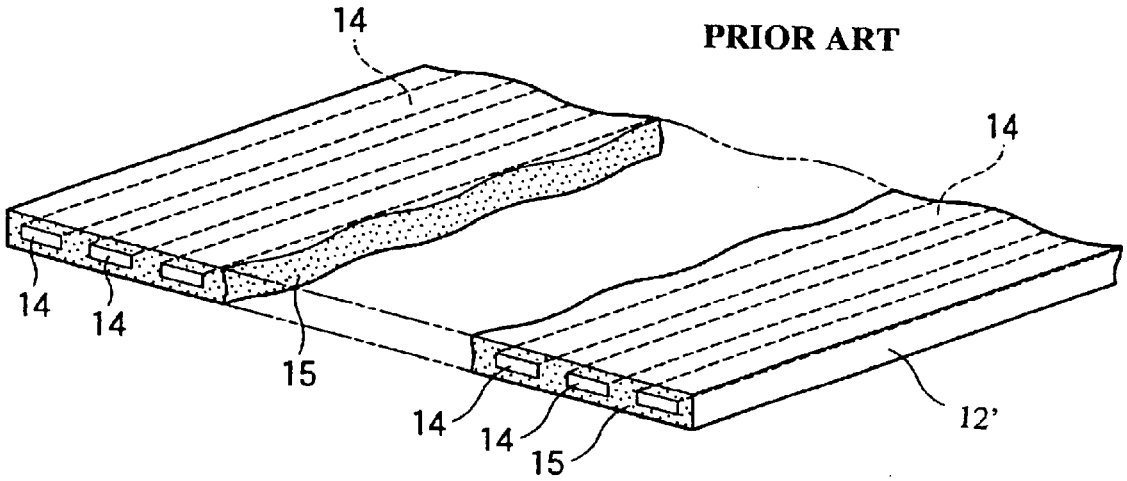
FIG.18 PRIOR ART
FIG. 18 is a perspective view of a flexible flat cable in the related-art ink jet recording apparatus.
Figure 19:
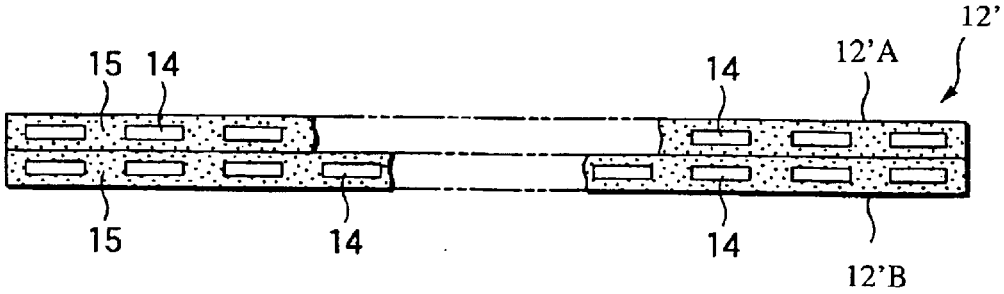
FIG.19 PRIOR ART
FIG. 19 is a cross-sectional view of a laminated-type flexible flat cables in the related-art ink jet recording apparatus.
Figure 20A:
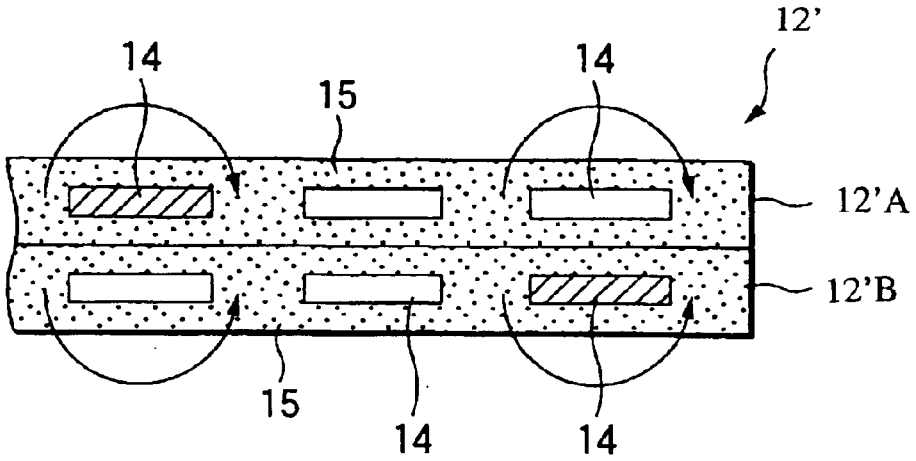
PRIOR ART FIG.20A
FIGS. 20A and 20B are cross-sectional views showing the polarity relationship of the flexible flat cable in the related-art ink jet recording apparatus.
Figure 20B:
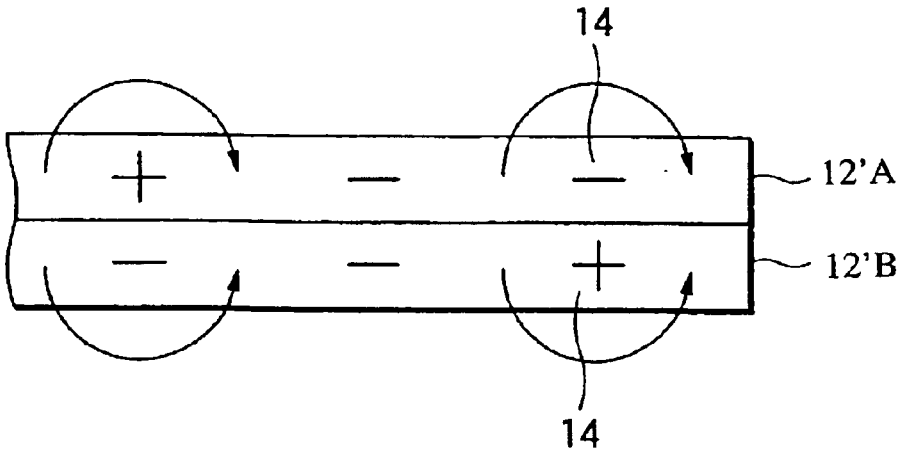
PRIOR ART FIG.20B

FIG. 1 shows an ink jet recording apparatus according to a first embodiment of the invention. Since this structure is basically the same as that shown in FIG. 17, the same reference numerals are used to denote corresponding components and detailed explanation will be omitted.

The recording head 2 will now be explained with reference to FIG. 2. A channel unit 16 is formed by laminating a nozzle plate 18 formed with nozzle orifices 17, a channel forming substrate 20 formed with pressure chambers 19 communicate with the nozzle orifices 17, and a vibration plate 21 for closing the lower openings of the pressure chambers 19. Ink reservoirs 23 which store ink to be introduced into the pressure chambers 19 are formed in the channel forming substrate 20 and communicated with the pressure chambers 19 via ink channels 22.

A head case 24, which is a principal member of the recording head 3, is formed by the injection molding of a thermosetting resin or a thermoplastic resin. Piezoelectric vibrators 26 (pressure generating elements) are accommodated in spaces 25 that penetrate the head case 24 vertically. The rear ends of the piezoelectric vibrators 26 are bonded to fixed plates 27 that are attached to the head case 24, and the distal ends thereof are secured to island portions 21A on the lower face of the vibration plate 21.

Figure 2:
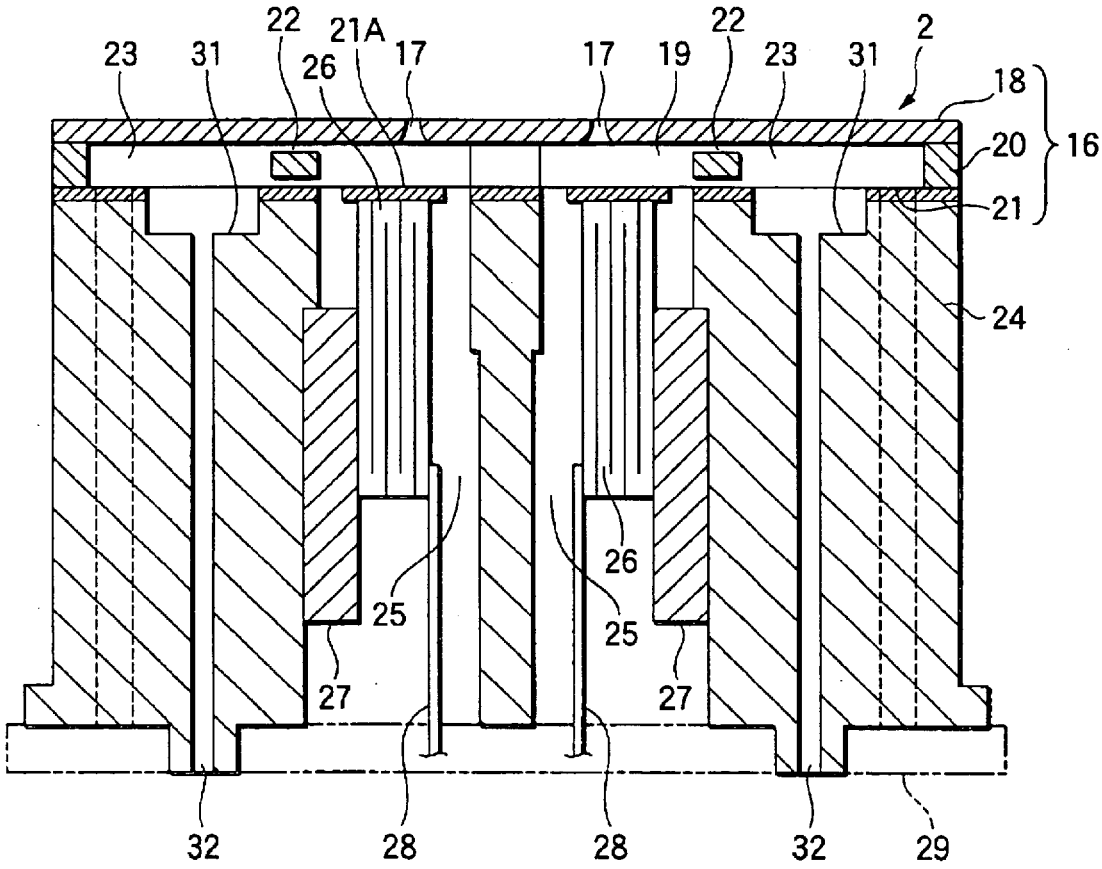
FIG. 2 is a cross-sectional view of a recording head in the ink jet recording apparatus.

The pressure chambers 19, the piezoelectric vibrators 26 and the nozzle orifices 17 are arranged in the direction perpendicular to the sheet surface of FIG. 2. That is, in this example, two nozzle arrays are formed, and the same type of ink is ejected by one nozzle array regarded as a single unit.

Figure 3:
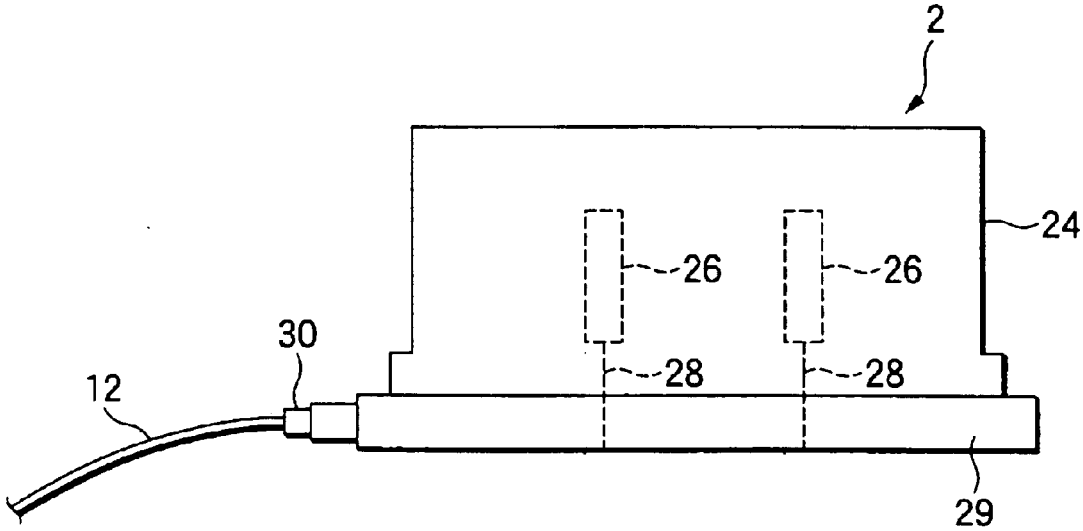
FIG. 3 is a schematic side view of the recording head.

Input conductive lines 28 are connected to the piezoelectric vibrators 26 as shown in FIG. 2, and are also connected to a head board 29 as shown in FIG. 3. The flexible flat cable 12 is coupled with a connector 30 provided at the end of the head board 29, and the conductive lines 28 are electrically connected to the flexible flat cable 12 by the head board 29. When a drive signal is transmitted to the piezoelectric vibrators 26 along this conductivity path, the piezoelectric vibrators 26 are longitudinally extended or contracted, varying the pressure in the pressure chambers 19, so that ink in the pressure chambers 19 is ejected as droplets through the nozzle orifices 17.

Figure 4A:
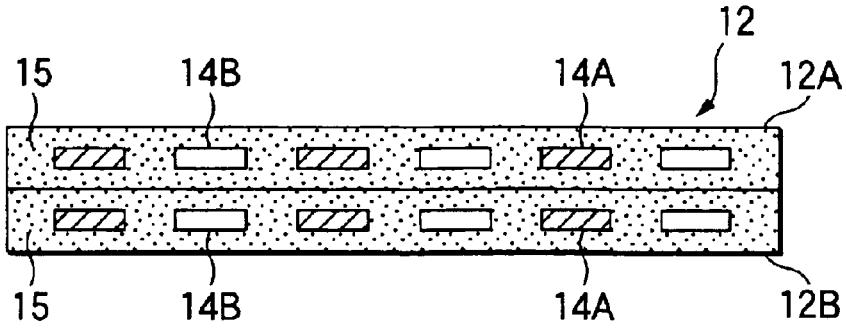
FIGS. 4A and 4B are cross-sectional views of a flexible flat cable in the ink jet recording apparatus.
Figure 4B:
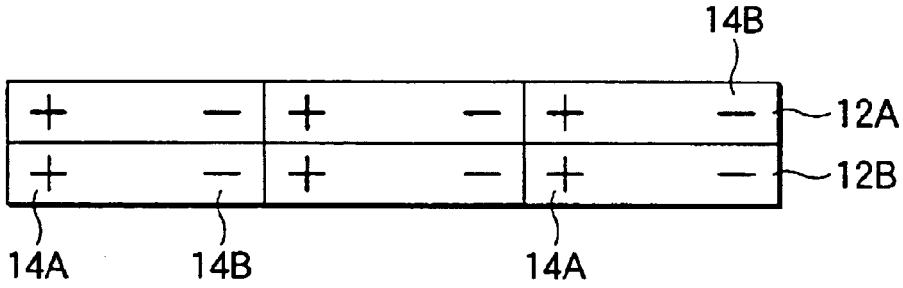

As shown in FIGS. 4A and 4B, the flexible flat cable 12 is formed by laminating a first flexible flat cable 12A and a second flexible flat cable 12B. In FIG. 4A, hatched conductive patterns 14 are positive conductive patterns 14A and non-hatched conductive patterns 14 are negative conductive patterns 14B. The positive conductive patterns 14A and the negative conductive patterns 14B of the flexible flat cables 12A and 12B are arranged facing each other. That is, the conductive patterns 14 facing each other have the same polarity. For better understanding, FIG. 4B depicts only the polarities instead of the conductive patterns 14. The following explanation of this embodiment will be given by referring to this example.

In the example in FIGS. 4A and 4B, each of the input lines extending from the drive circuit 9 to the piezoelectric vibrators 26 is formed of one positive conductive pattern 14A and one negative conductive pattern 14B are alternately arranged. In other words, a positive conductive pattern 14A and a negative conductive pattern 14B are paired to form one input line unit to transmit a drive signal to the piezoelectric vibrator 26 that corresponds to one kind of ink. Therefore, when six pairs of them are provided, as is shown in FIGS. 4A and 4B, a total of six ink kinds (e.g. colors), corresponding to six nozzle arrays, are ejected. For this example the six ink colors are black, yellow, magenta, cyan, light magenta and light cyan.

According to the first embodiment, since the positive conductive patterns 14A and the negative conductive patterns 14B are arranged in the same order, the conductive patterns 14 of the flexible flat cables 12A and 12B that face each other have the same polarity. Therefore, the current reduction does not occur due to the mutual inductance described the above, and a desired drive signal is input to the piezoelectric vibrators 26 that normalizes the ink ejection state at the nozzle orifices 17.

Since the number of the conductive patterns 14A and 14B that can be arranged can be increased considerably because of the laminated structure of the flexible cable 12, the types of drive signals transmitted by the drive circuit 9 to the piezoelectric vibrators 26 can be increased, and this can effectively improve the function of the recording head 2.

Figure 5:
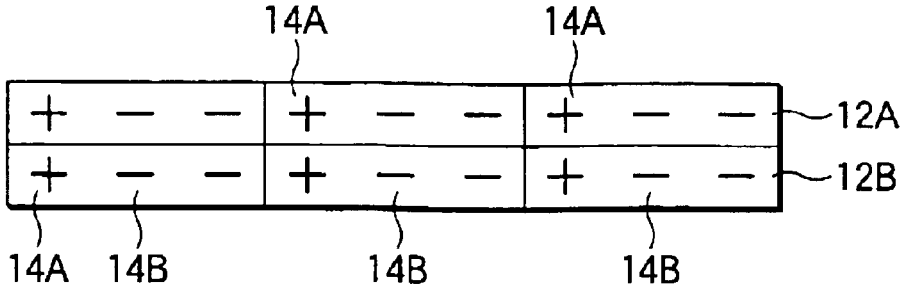
FIG. 5 is a cross-sectional view of a flexible flat cable according to a second embodiment of the invention.

FIG. 5 shows a second embodiment of the invention. In this embodiment, as each input line, one positive conductive pattern 14A is provided to connect the positive pole of the drive circuit 9 to the positive poles of the piezoelectric vibrators 26, and two negative conductive patterns 14B are provided to connect the negative pole of the drive circuit 9 to the negative poles of the piezoelectric vibrators 26. The "positive" conductive patterns 14A, the "negative" conductive pattern 14B and the "negative" conductive patterns 148 are repetitively arranged in this order from left to right. The remainder of the configuration is the same as in for the first embodiment, and the same reference numerals are used to denote corresponding components.

According to the second embodiment, since two negative conductive patterns 14B are provided for each input line unit, the current flowing in these patterns is reduced, and the affect attributable to the mutual inductance of the first and the second flexible flat cables 12A and 12B is reduced. Therefore, the piezoelectric vibrators 26 corresponding to the individual ink colors can be operated more normally, shortages of the ink to be ejected will not occur, and there is a considerable reduction in the incidence of printing failures. The other effects obtained in this embodiment are the same as those in the first embodiment.

Figure 6:
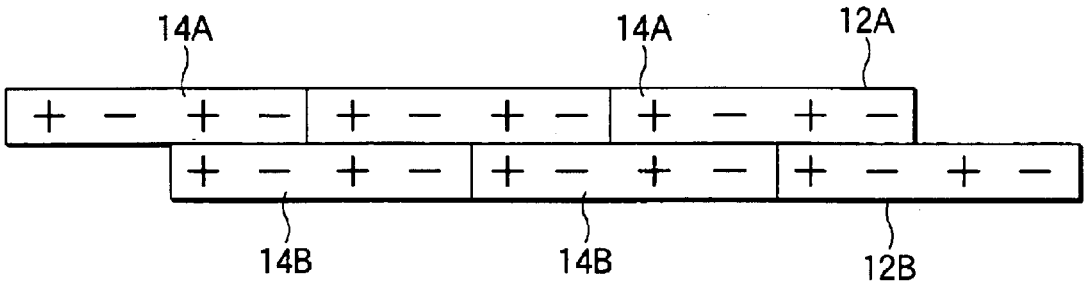
FIG. 6 is a cross-sectional view of a flexible flat cable according to a third embodiment of the invention.

FIG. 6 shows a third embodiment of the invention. In this embodiment, two positive conductive patterns 14A and two negative conductive patterns 14B are provided for each input line unit, and these patterns are alternately arranged. In this case, in order the same poles to face each other, the second flexible flat cable 12B is shifted relative to the first flexible flat cable 12A a distance equivalent to two conductive patterns. The remainder of the configuration is the same as in the first and the second embodiments, and the same reference numerals are employed to denote corresponding components.

According to the third embodiment, since the current flowing in one positive conductive pattern 14A and one negative conductive pattern 14B is reduced, the magnetic affect attributable to each conductive pattern 14 can be reduced, and the affect attributable to the disturbance relative to a peripheral device can be reduced considerably. The other effects are the same as those obtained in the two embodiments.

Figure 7:
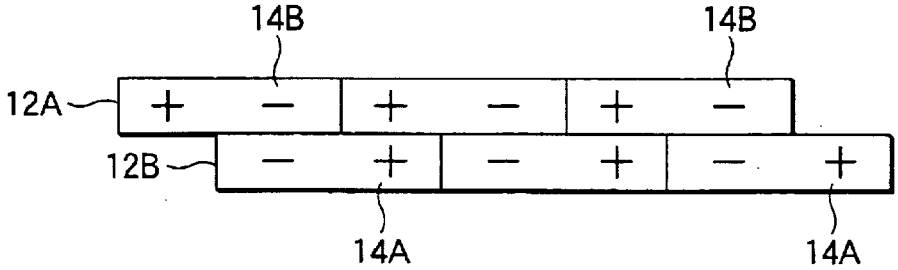
FIG. 7 is a cross-sectional view of a flexible flat cable according to a fourth embodiment of the invention.

FIG. 7 shows a fourth embodiment of the invention. In this embodiment, the first flexible flat cable 12A is shifted widthwise relative to the second flexible flat cable 12B a distance equivalent to one conductive pattern, and the positive and negative conductive patterns 14A and 14B of the first flexible flat cable 12A are arranged in an inverted order relative to those of the second flexible flat cable 128. It should be noted that one positive conductive pattern 14A and one negative conductive pattern 14B are provided for each input line. That is, in this example, for the upper, first flexible flat cable 12A, the "positive" conductive patterns 14A and the "negative" conductive patterns 14B are arranged in this order from left to right, while for the lower, second flexible flat cable 12B, the "negative" conductive patterns 14B and the "positive" conductive patterns 14A are arranged in this order from left to right. The remainder of the structure is the same as in the previous embodiments, and the same reference numerals are employed to denote corresponding components.

According to the fourth embodiment, even when the order in which the conductive patterns 14 are arranged for the flexible flat cables 12A and 12B is inverted, these cables 12A and 12B need only be shifted to establish the principle according to which like poles face each other. In other words, even when due to the polarities of the terminals of the drive circuit 9 and the pressure generating elements the inverted order arrangement is selected, an arrangement can be implemented in which like poles face each other. The other effects are the same as those in the first to third embodiments.

Figure 8:
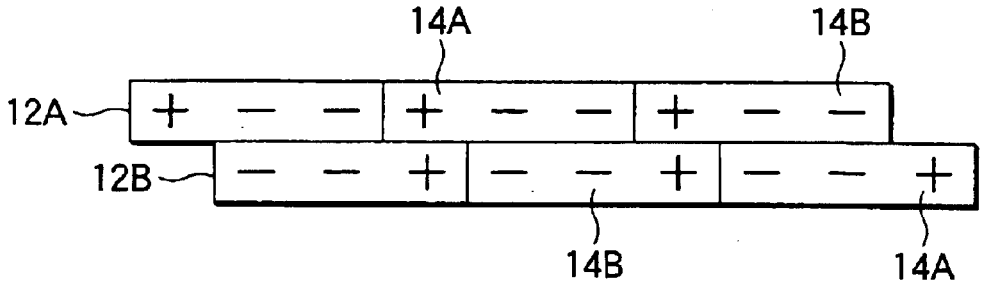
FIG. 8 is a cross-sectional view of a flexible flat cable according to a fifth embodiment of the invention.

FIG. 8 shows a fifth embodiment of the invention. In this embodiment, as in the fourth embodiment, the first flexible cable 12A and the second flexible flat cable 12B are shifted widthwise relative to each other a distance equivalent to one conductive pattern 14, and the order in which the positive and negative conductive patterns 14A and 14B of the first flexible flat cable 12A are arranged is inverted relative to that of the second flexible flat cable 12B. For each input line unit, one positive conductive pattern 14A and two negative conductive patterns 14B are provided. That is, in this embodiment, for the upper, first flat flexible cable 12A, the "positive" conductive pattern 14A, the "negative" conductive patterns 14B and the "negative" conductive pattern 14B are repetitively arranged in this order from left to right, while for the lower, second flexible flat cable 12B, the "negative" conductive patterns 14B, the "negative" conductive patterns 14B and the "positive" conductive pattern 14A are repetitively arranged in this order from left to right. The remainder of the arrangement is the same as that for the first to fourth embodiments, and the same reference numerals are used to denote corresponding components.

According to the fifth embodiment, even when the conductive patterns 14 for the flexible flat cables 12A and 12B are arranged in the inverted order, these cables need only be shifted to establish the principle according to which like poles face each other. In other words, even when due to the polarities of the terminals of the drive circuit and the piezoelectric generating elements the arrangement in the inverted order is selected, an arrangement can be implemented in which like poles face each other. The other effects obtained in this embodiment are the same as those in the first to fourth embodiments.

Figure 9:
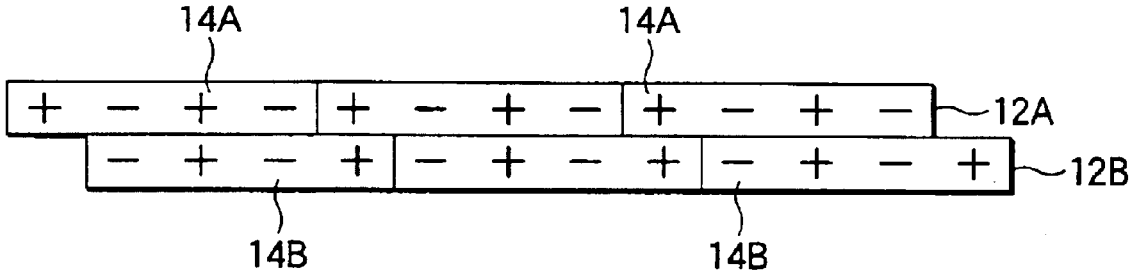
FIG. 9 is a cross-sectional view of a flexible flat cable according to a sixth embodiment of the invention.

FIG. 9 shows a sixth embodiment of the invention. In this embodiment, the first flexible flat cable 12A and the second flexible flat cable 12B are shifted widthwise relative to each other a distance equivalent to one conductive pattern, and the order in which the positive and negative conductive patterns 14A and 14B of the first flexible flat cable 12A are arranged is inverted relative to that of the second flexible flat cable 12B. That is, for the upper, first flexible flat cable 12A, the "positve" conductive patterns 14A and the "negative" conductive patterns 14B are arranged this order from left to right, while for the lower, second flexible flat cable 12B, the "negative" conductive patterns 14B and the "positive" conductive patterns 14A are arranged in this order from left to right. It should be noted that two positive conductive patterns 14A and two negative conductive patterns 14B are provided for each input line unit. The remainder of the arrangement is the same as that for the first to fifth embodiments, and the same reference numerals are used to denote corresponding components.

For this embodiment, the same effects can also be obtained as are obtained for the previous embodiments.

Figure 10:
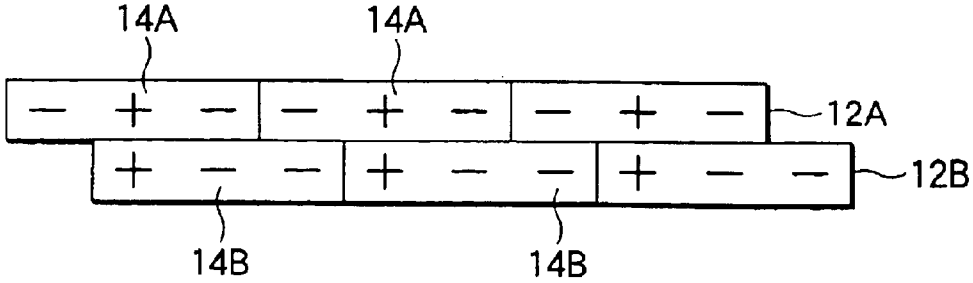
FIG. 10 is a cross-sectional view of a flexible flat cable according to a seventh embodiment of the invention.

FIG. 10 shows a seventh embodiment of the invention. In this embodiment, the first flexible flat cable 12A and the second flexible flat cable 12B are shifted widthwise relative to each other a distance equivalent to one conductive pattern, and one positive conductive pattern 14A and two negative conductive patterns 14B are paired for each input line unit. For the upper, first flexible flat cable 12A, the "negative" conductive pattern 14B, the "positive" conductive pattern 14A and the "negative" conductive pattern 14A are repetitively arranged in this order from left to right, while for the lower, second flexible flat cable 12B, the "positive" conductive pattern 14A, the "negative" conductive pattern 14B and the "negative" conductive pattern 14B are repetitively arranged in this order from left to right. The remainder of the arrangement is the same as that for the previous embodiments, and the same reference numerals are used to denote corresponding components.

For this embodiment, the same effects can also be obtained as are obtained for the previous embodiments.

Figure 11:
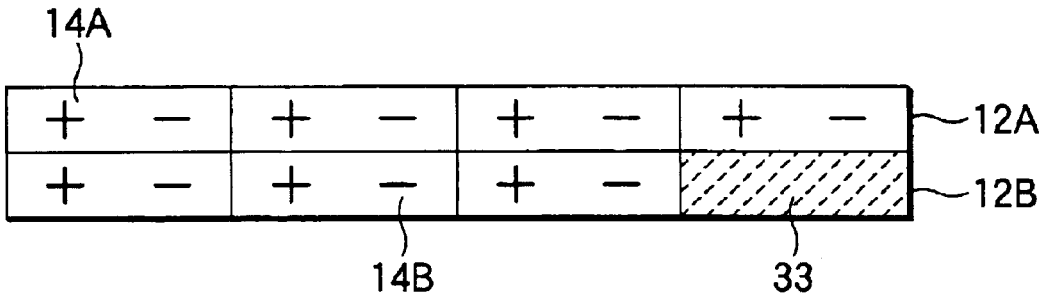
FIG. 11 is a cross-sectional view of a flexible flat cable according to an eighth embodiment of the invention.

FIG. 11 shows an eighth embodiment of the invention. In this embodiment, an auxiliary conductive pattern 33, in which a drive signal for the piezoelectric vibrator 26 is not transmitted, is formed at the location, in the flexible flat cable 12A or 12B in the laminated structure, that corresponds to the conductive pattern 14 in which the drive signal for the piezoelectric vibrator 26 is transmitted. In this arrangement, a signal, such as a ground signal, a temperature detection signal or another power signal, that mutually is less affected by the drive signal is transmitted to the auxiliary conductive pattern 33. The remainder of the arrangement is the same as for the first to seventh embodiments, and the same reference numerals are used to denote corresponding components.

According to the eighth embodiment, since an extra conductive pattern can be selected, it can be utilized as a ground line, a temperature detection line or another power feed line and will provide no side effects for the drive signal. The other effects obtained are the same as those for the previous embodiments.

Figure 12:
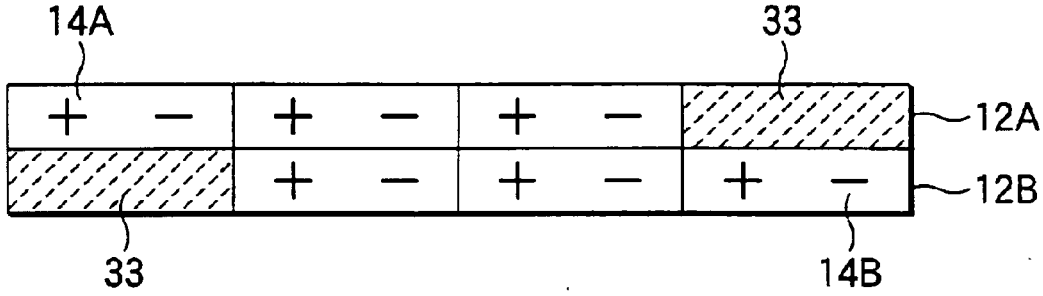
FIG. 12 is a cross-sectional view of a flexible flat cable according to a ninth embodiment of the invention.

FIG. 12 shows a ninth embodiment of the invention. In this embodiment, two auxiliary conductive patterns 33 are provided, one for each of the flexible flat cables 12A and 12B, and are respectively located on the right and left sides. The remainder of the arrangement is the same as that for the previous embodiments, and the same reference numerals are used to denote corresponding components.

According to the ninth embodiment, since two auxiliary conductive patterns 33 are provided, more diversified use can be made of the extra conductive patterns. The other effects are the same as those for the previous embodiments.

Figure 13:
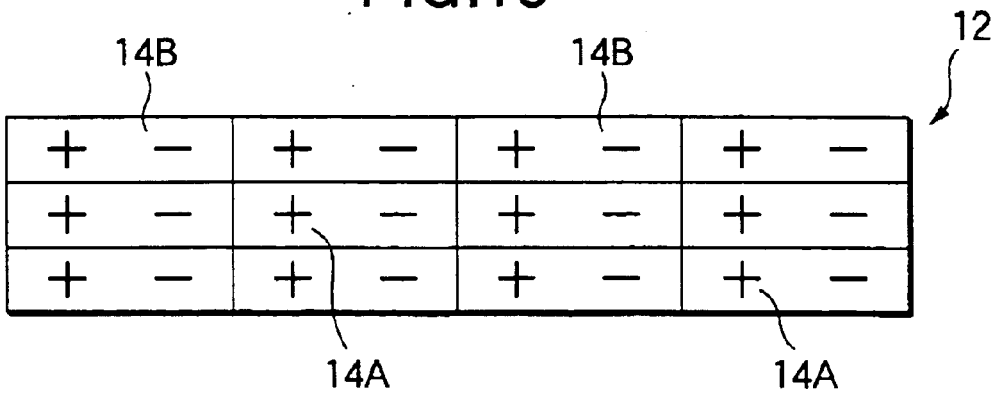
FIG. 13 is a cross-sectional view of a flexible flat cable according to a tenth embodiment of the invention.
Figure 14:
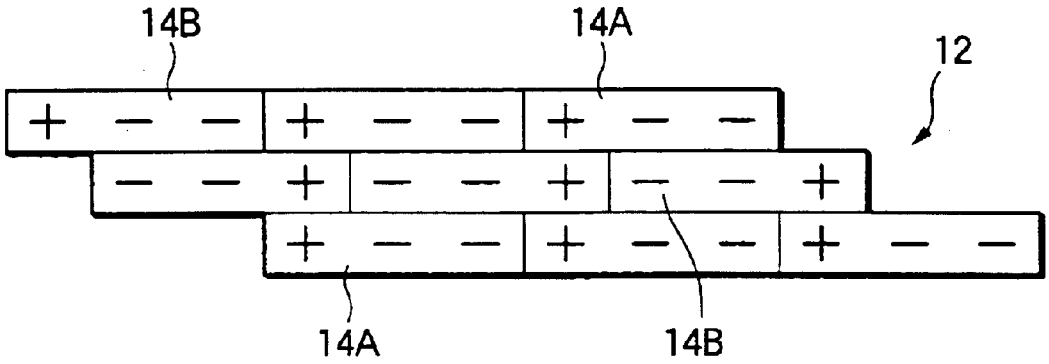
FIG. 14 is a cross-sectional view of a modified example of the flexible flat cable as shown in FIG. 13.

FIGS. 13 and 14 show a tenth embodiment of the invention. In this embodiment, the flexible flat cable 12 is formed by laminating three layers. The remainder of the arrangement is the same as that for the first to ninth embodiments, and the same reference numerals are used to denote corresponding components.

According to the tenth embodiment, since the three-layered flexible flat cable 12 is employed, more drive signals and a variety of control signals can be transmitted to the recording head 2. Further, since the width of the flexible flat cable 12 can be reduced, the portion of the flexible flat cable 12 that is bent during printing can be reduced, so that the downsizing of a recording apparatus can be realized. The other effects are the same as those for the previous embodiments.

Figure 15:
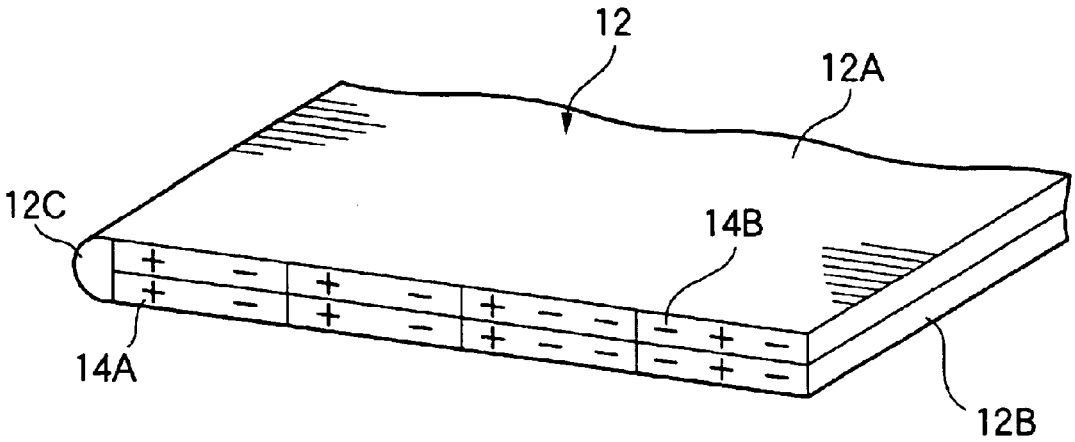
FIG. 15 is a perspective view of a flexible flat cable according to an eleventh embodiment of the invention.

FIG. 15 shows an eleventh embodiment of the invention. In this embodiment, the flexible flat cable 12 is folded over onto itself along a fold line 12C that extends in the longitudinal direction of the cable 12. The fold line 12C is so positioned that, when the flexible flat cable 12 is folded, the same poles in the positive conductive patterns 14A and the negative patterns 14B face each other. The remainder of the arrangement is the same as for the first to tenth embodiments, and the same reference numerals are used to denote corresponding components.

According to the eleventh embodiment, even if a wide flexible flat cable 12 is employed, spatial disadvantages can be avoided by folding the flexible flat cable 12 over onto itself. In addition, since only a single, folded flexible flat cable 12 is used, the number of parts is not increased and the manufacturing process is simplified, making this is an extremely effective cost reduction arrangement.

Figure 16:
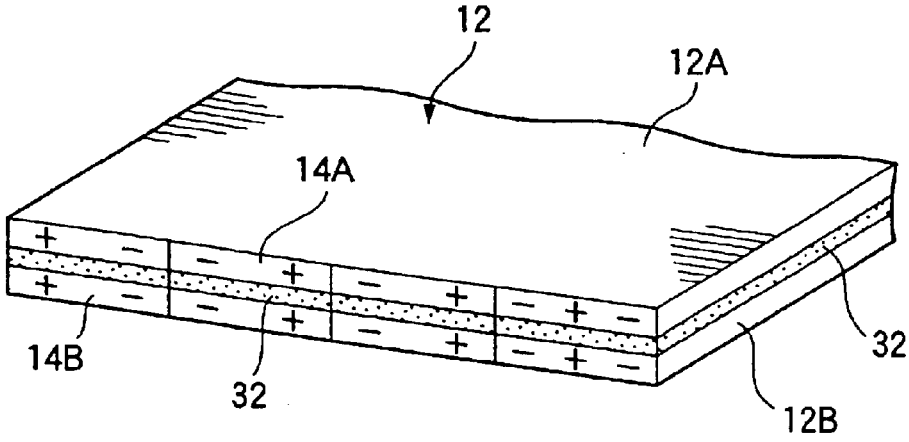
FIG. 16 is a perspective view of flexible flat cable according to a twelfth embodiment of the invention.

FIG. 16 shows a twelfth embodiment of the invention. In this embodiment, the flexible flat cable 12 is formed by bonding the first flexible flat cable 12A to the second flexible flat cable 12B using an adhering layer 32, such as an adhesive or a double coated adhesive tape. The remainder of the arrangement is the same as for the other embodiments, and the same reference numerals are used to denote corresponding components.

According to the twelfth embodiment, since through the bonding the flexible flat cables 12A and 12B are integrally formed, these cables 12A and 12B will not be easily peeled apart, even when they are repetitively bent during printing, and the establishment of the principle according to which conductive patterns face conductive patterns having like poles is ensured.

In the embodiments of the invention, the piezoelectric vibrators 26 of the vertical oscillation mode are employed as pressure generating elements. However, the pressure generating element is not limited to an application of this type, and piezoelectric vibrators of a flexure oscillation mode or heating devices for heating ink in the pressure chambers may also be employed.

Further, in the above embodiments, the description was made with reference to the ink jet recording apparatus, which is a kind of the liquid jetting apparatus. However, the present invention can be applied to other kind of liquid jetting apparatus. For instance, an electrode member ejection head for an electrode forming apparatus, an organic substance jetting head for a bio-chip manufacturing apparatus, or the like.

What is claimed is:

1. An liquid jetting apparatus, comprising:

a liquid jetting head, provided with nozzle orifices, pressure chambers each commutated with one of the nozzle orifices, and pressure generating elements each associated with one of the pressure chambers to vary pressure of ink contained therein;

a drive circuit, which generates a drive signal for driving at least one of the pressure generating elements; and a flexible flat cable, which connects the drive circuit and the liquid jetting head to supply the drive signal to at least one of the pressure generating elements, the flat cable including a plurality of layers, each provided with a plurality of first conductive patterns each connecting a positive pole of the drive circuit and a positive pole of one of the pressure generating elements, and a plurality of second conductive patterns each connecting a negative pole of the drive circuit and a negative pole of one of the pressure generating elements, wherein:

at least one of the first conductive patterns provided in one of the layers faces one of the first conductive patterns provided in another one of the layers; and at least one of the second conductive patterns provided in one of the layers faces one of the second conductive patterns provided in another one of the layers, wherein each of the plurality of layers is formed of a single layer, which includes the first conductive patterns and the second conductive patterns.

2. The liquid jetting apparatus as set forth in claim 1, wherein:

the first conductive patterns facing with each other are associated with pressure generating elements for ejecting different kinds of ink; and the second conductive patterns facing with each other are associated with pressure generating elements for ejecting different kinds of ink.

3. The liquid jetting apparatus as set forth in claim 1, wherein at least one of the first conductive patterns and at least one of second conductive patterns provided in each of the layers are connected to at least one of the pressure generating elements for ejecting one kind of ink.

4. The liquid jetting apparatus as set forth in claim 3, wherein one of the first conductive patterns and two of the second conductive patterns provided in each of the laminated layers are connected to at least one of the pressure generating elements for ejecting one kind of ink.

5. The liquid jetting apparatus as set forth in claim 1, wherein an arrangement order of the first conductive patterns and the second conductive patterns provided in one of the layers is identical with an arrangement order of the first conductive patterns and the second conductive patterns provided in adjacent one of the layers.

6. The liquid jetting apparatus as set forth in claim 5, wherein the first conductive patterns and the second conductive patterns provided in each of the layers are alternately arranged.

7. The liquid jetting apparatus as set forth in claim 1, wherein an arrangement order of the first conductive patterns and the second conductive patterns provided in one of the laminated layers is inverse to an arrangement order of the first conductive patterns and the second conductive patterns provided in adjacent one of the laminated layers.

8. The liquid jetting apparatus as set forth in claim 7, wherein the first conductive patterns and the second conductive patterns provided in each of the laminated layer are alternately arranged.

9. The liquid jetting apparatus as set forth in claim 1, wherein an auxiliary conductive pattern for supplying a signal other than the drive signal to the liquid jetting head is provided in at least one of the laminated patterns so as to face at least one of the first conductive patterns and the second conductive patterns.

10. The liquid jetting apparatus as set forth in claim 1, wherein the flat cable includes a connecting section extending in a longitudinal direction thereof at one widthwise side end so as to integrally connect one of the laminated layers and adjacent one of the laminated layers.

11. The liquid jetting apparatus as set forth in claim 1, wherein an adhesive layer is interposed between one of the laminated layers and adjacent one of the laminated layers.

12. The liquid jetting apparatus as set forth in claim 1, wherein the pressure generating elements are one of longitudinal oscillation type piezoelectric vibrators, flexure oscillation type piezoelectric vibrators and heating elements for heating ink in the pressure chambers.

13. The liquid jetting apparatus according to claim 1, wherein the plurality of layers are laminated together.

14. An liquid jetting apparatus, comprising:

a liquid jetting head, provided with nozzle orifices, pressure chambers each commutated with one of the nozzle orifices, and pressure generating elements each associated with one of the pressure chambers to vary pressure of ink contained therein;

a drive circuit, which generates a drive signal for driving at least one of the pressure generating elements; and a flexible flat cable, which connects the drive circuit and the liquid jetting head to supply the drive signal to at least one of the pressure generating elements, the flat cable including a plurality of layers, each provided with a plurality of first conductive patterns each connecting a positive pole of the drive circuit and a positive pole of one of the pressure generating elements, and a plurality of second conductive patterns each connecting a negative pole of the drive circuit and a negative pole of one of the pressure generating elements, wherein:

at least one of the first conductive patterns provided in one of the layers faces one of the first conductive patterns provided in another one of the layers; and at least one of the second conductive patterns provided in one of the layers faces one of the second conductive patterns provided in another one of the layers, wherein one of the layers is shifted relative to adjacent one of the layers in an arrangement direction of the first conductive patterns and the second conductive patterns by a distance equivalent to at least one of the first conductive patterns and the second conductive patterns.

15. An liquid jetting apparatus, comprising:

a liquid jetting head, provided with nozzle orifices;

a plurality of pressure chambers, each communicating with one of the nozzle orifices;

a plurality of pressure generating elements, each associated with one of the plurality of pressure chambers to vary pressure of ink contained therein;

a drive circuit, which generates a drive signal for driving at least one of the plurality of pressure generating elements; and a flexible flat cable, which connects the drive circuit and the liquid jetting head to supply the drive signal to at least one of the plurality of pressure generating elements, the flat cable including a plurality of layers, each layer provided with a plurality of first conductive patterns and a plurality of second conductive patterns, wherein the plurality of first conductive patterns each connect a positive pole of the drive circuit and a positive pole of one of the plurality of pressure generating elements, and the plurality of second conductive patterns each connect a negative pole of the drive circuit and a negative pole of one of the plurality of pressure generating elements, wherein at least one of the first conductive patterns provided in one of the layers faces one of the first conductive patterns provided in another one of the layers;

wherein at least one of the second conductive patterns provided in the one of the layers faces one of the second conductive patterns provided in the another one of the layers, and wherein each of the plurality of layers is formed of a single layer.

16. The liquid jetting apparatus according to claim 15, wherein the plurality of layers are laminated together.

* * * * *